US008420172B1

(12) United States Patent
Loper et al.

(10) Patent No.: US 8,420,172 B1
(45) Date of Patent: Apr. 16, 2013

(54) APPARATUS AND METHOD OF MANUFACTURING SHINGLES FROM CELLULAR POLYVINYL CHLORIDE

(75) Inventors: Thomas Loper, Wilbraham, MA (US); David Bilodeau, Hadley, MA (US)

(73) Assignee: Jain (Americas) Inc., Columbus, OH (US)

( * ) Notice: Subject to any disclaimer, the term of this patent is extended or adjusted under 35 U.S.C. 154(b) by 180 days.

(21) Appl. No.: 13/091,306

(22) Filed: Apr. 21, 2011

Related U.S. Application Data

(60) Provisional application No. 61/326,720, filed on Apr. 22, 2010.

(51) Int. Cl.
*B05D 3/12* (2006.01)
*B05D 1/28* (2006.01)

(52) U.S. Cl.
USPC ..... 427/289; 427/429

(58) Field of Classification Search ..... 427/289, 427/290, 429; 52/518, 553, 309.1; 521/50
See application file for complete search history.

(56) References Cited

U.S. PATENT DOCUMENTS

| | | | | |
|---|---|---|---|---|
| 5,635,125 | A * | 6/1997 | Ternes et al. | 264/328.18 |
| 5,992,116 | A * | 11/1999 | Ternes et al. | 52/518 |
| 6,247,284 | B1 * | 6/2001 | Alvarez et al. | 52/553 |
| 6,790,307 | B2 * | 9/2004 | Elliott | 156/260 |
| 2010/0058691 | A1 * | 3/2010 | Mannion | 52/309.3 |

* cited by examiner

*Primary Examiner* — Kelly M Gambetta
(74) *Attorney, Agent, or Firm* — Roger A. Gilcrest

(57) ABSTRACT

A method for forming shingles from cellular polyvinyl chloride boards comprising brushing, parting, cutting and coating the boards to desired dimensions and finish. The method comprises passing cellular polyvinyl chloride boards through one or more of a specially designed brushing assembly, cross cut saw assembly, parting assembly, and sizing saw assembly, wherein the assemblies are in-line. The method may further include an in-line, high speed application and accelerated curing of a uniquely formulated solar reflective, ceramic-based finish.

15 Claims, 7 Drawing Sheets

APPARATUS AND METHOD OF MANUFACTURING SHINGLES FROM CELLULAR POLYVINYL CHLORIDE

CROSS REFERENCE TO RELATED APPLICATIONS

This application claims the benefit of U.S. Provisional Application No. 61/326,720 filed on Apr. 22, 2010.

BACKGROUND OF THE INVENTION

1. Field of the Invention

The present invention is generally directed to a process for preparing a shingle material. More particularly, the present invention relates to a process for preparing cellular polyvinyl chloride materials for use as shingles to mimic traditional, Western red cedar shingles.

2. Background of the Invention

Traditionally, side and roof shingles are made from Western red cedar or Eastern white cedar. In recent years, fiber cement and a variety of polymers have been pressed and/or injection molded to simulate the look of these wood standards. Each of these materials, however, has certain inherent problems that make them less than ideal from a building perspective.

For example, shingles made from cedar tends to absorb moisture, and to, consequently, warp, decay, and rot. Additionally, insects are attracted to the wood, and, therefore, contribute to the decay. Furthermore, when painted, the paint tends to blister, peel, and crack.

Although it absorbs less water than wood siding materials, fiber cement shingles do absorb some moisture if not carefully installed and maintained. To reduce the moisture and paint problems, the cut edges of the fiber cement shingles must be carefully treated. Furthermore, fiber cement shingles are flat (not beveled), unduly heavy, brittle, require specialized tools and instruments for installation, and debris formed during its installation may create health risks. For these reasons, then, fiber cement shingles are difficult to install and maintain, and because they are flat and uniform in appearance, they are not a close aesthetic match to wood shingles.

Molded polymer shingles and shingle panels improve upon the use of wood and fiber cement in that they are less subject to water related maintenance issues. However, molded shingles are very light and hollow giving them a less authentic appearance and feel. Additionally, molded shingles and panels must be overlapped to accommodate expansion and contraction. As a result, a tell-tale sign of molded polymer versus cedar and fiber cement shingles is the overlapping joints and repeating patterns that appear on most molded polymer installations. Also, molded shingles must be inserted into j-channel trim installed around windows, doors and at all corners in order to accommodate expansion and contraction of the polymer with changes in temperature. Further, molded polymer shingles and shingle panels have tended to discolor over time; thereby diminishing their perceived value considerably.

BRIEF SUMMARY OF THE INVENTION

The above-discussed drawbacks and deficiencies of the prior art are greatly reduced or eliminated by a novel in-line process and apparatus for preparing novel cellular polyvinyl chloride ("cellular PVC") shingles, wherein the process utilizes novel material removal, product handling, and finishing techniques.

An improved product for use as shingles and shingle panels is milled from cellular PVC sheet stock. Similar to molded polymer products, cellular PVC shingles expand and contract with changes in temperature, but when installed as individual shingles, this rate of expansion and contraction is negligible allowing contractors to install this product in the same manner that they have used for cedar shingles for centuries. Cellular PVC shingles and shingle panels can be finished with solar reflective, ceramic-based coatings that minimize fade and optimize performance (no cracking, peeling or blistering). Very importantly, research by the Department of Energy demonstrates that such coatings, when used on cellular PVC, can produce annual HVAC savings of 5-9%, depending upon the location in North America.

The inventive process comprises passing cellular PVC boards/bolts through one or more of a specially designed brushing assembly, cross cut saw assembly, parting assembly, and sizing saw assembly. The inventive process further incorporates an in-line, high speed application and accelerated curing of a uniquely formulated solar reflective, ceramic-based finish. Accordingly, the invention relates to a novel process for converting large cellular PVC boards for use as shingles. These large boards are readily available from many sources and therefore can be obtained at low cost. The subject process utilizes this material in a highly efficient way to produce cellular PVC shingles, with their many inherent advantages, at a cost comparable to conventional Western red cedar shingles that have been primed and field coated.

DETAILED DESCRIPTION OF THE INVENTION

Disclosed herein is a novel, in-line, method for preparing shingles formed from cellular PVC. Utilizing cellular PVC as the basic material for manufacturing the final shingle product produces a finished product free of checks, knots and other defects normally associated with wood shingles. Further, the manufacturing process of the present invention produces shingles that are extremely consistent in taper and squareness while minimizing waste by utilizing at least 98 percent of the raw material during manufacture.

Figure 1:
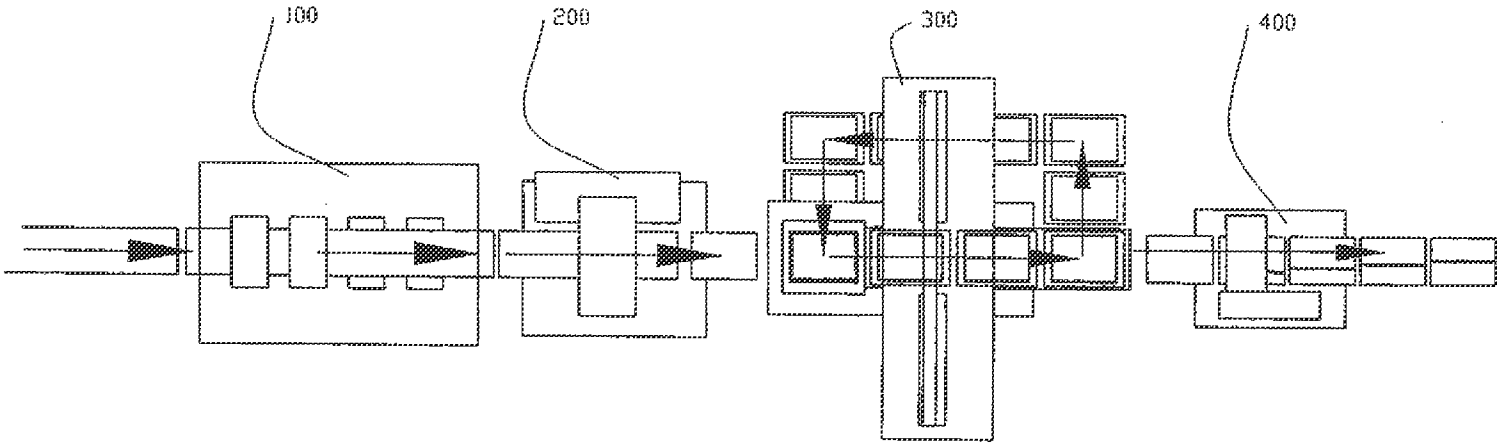
FIG. 1 is a schematic depicting an overview of an exemplary manufacturing process.
Figure 2:
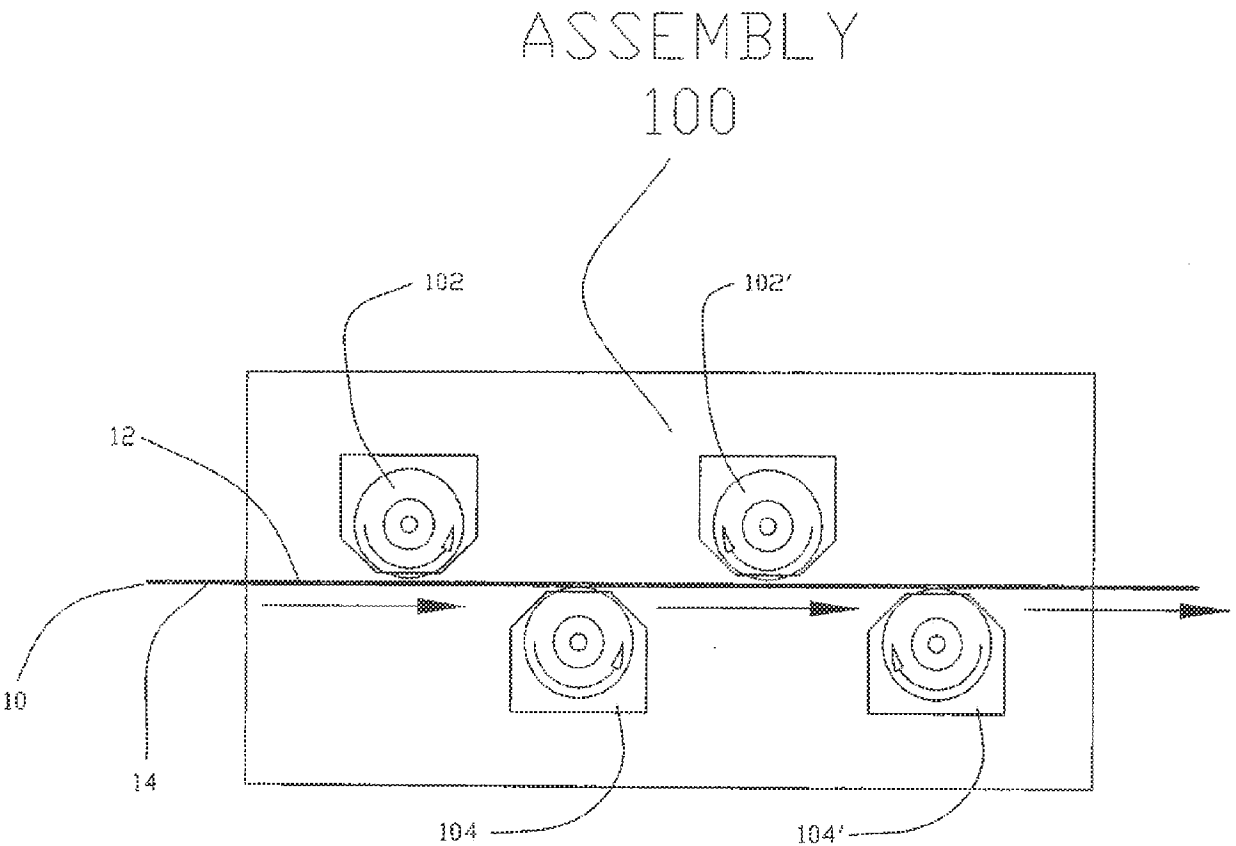
FIG. 2 is a schematic depicting an exemplary brushing assembly.

Referring to FIG. 1, an exemplary method comprises brushing a top face and a bottom face of a cellular PVC board to create a textured pattern on the board via a brushing assembly 100, cutting the board into specified shingle lengths via a cross cut saw assembly 200, parting the cellular PVC board to create profiled boards via a parting saw assembly 300, cutting the profiled cellular PVC boards into conventionally sized shingles via a sizing saw assembly 400, and painting the resulting shingles.

More specifically, and referring to FIGS. 2-5, a cellular PVC board 10 is passed through a brushing assembly 100, wherein the brushes forming brushing assembly 100 create a textured grain pattern along a length of board 10. Brushing assembly 100 comprises a brush 102 adjacent to a brush 102', and a brush 104 adjacent to a brush 104', wherein brushes 102 and 102' are oppositely situated to brushes 104 and 104'. Board 10, which in an exemplary embodiment comprises an approximately ½ inch depth, an approximately 12 inch width, and an approximately 16 foot length, is passed lengthwise through brushing assembly 100 at approximately 30 feet per minute such that brushes 102 and 102' brush against a top face 12 of board 10, and brushes 104 and 104' brush against a bottom face 14 of board 10 at a rate of about 1,000 revolutions per minute ("RPM"). To neutralize the forces exerted against board 10, in an exemplary embodiment, brush 102 rotates in a direction opposite to that of brush 102' and brush 104 rotates in a direction opposite to that of brush 104' whilst board 10 is passing through brushing assembly 100. For example, should brushes 102 and 104 rotate clockwise, brushes 102' and 104' preferably rotate counterclockwise.

In an exemplary embodiment, one or more of brushes 102, 102', 104 and 104' comprises densely packed bristles surrounding a steel tube core with an overall diameter of about 10 inches. Bristle characteristics such as density, temper, stiffness and varying length all combine to produce a brush, that when spun at approximately 1,000 RPM and brought against the surface of a cellular PVC board produces a surface texture that is generally identical in appearance to real rough-sawn wood. In an exemplary embodiment, the crimped, preferably copper plated, bristles comprise a gauge of about 28, and, preferably, randomly vary in length between about 1.75 inches to about 2 inches long. Furthermore, in an exemplary embodiment, the bristles are densely packed and pressed into a steel u-channel which is tightly spiral wrapped around an approximately 6 inch diameter tube.

Figure 3:
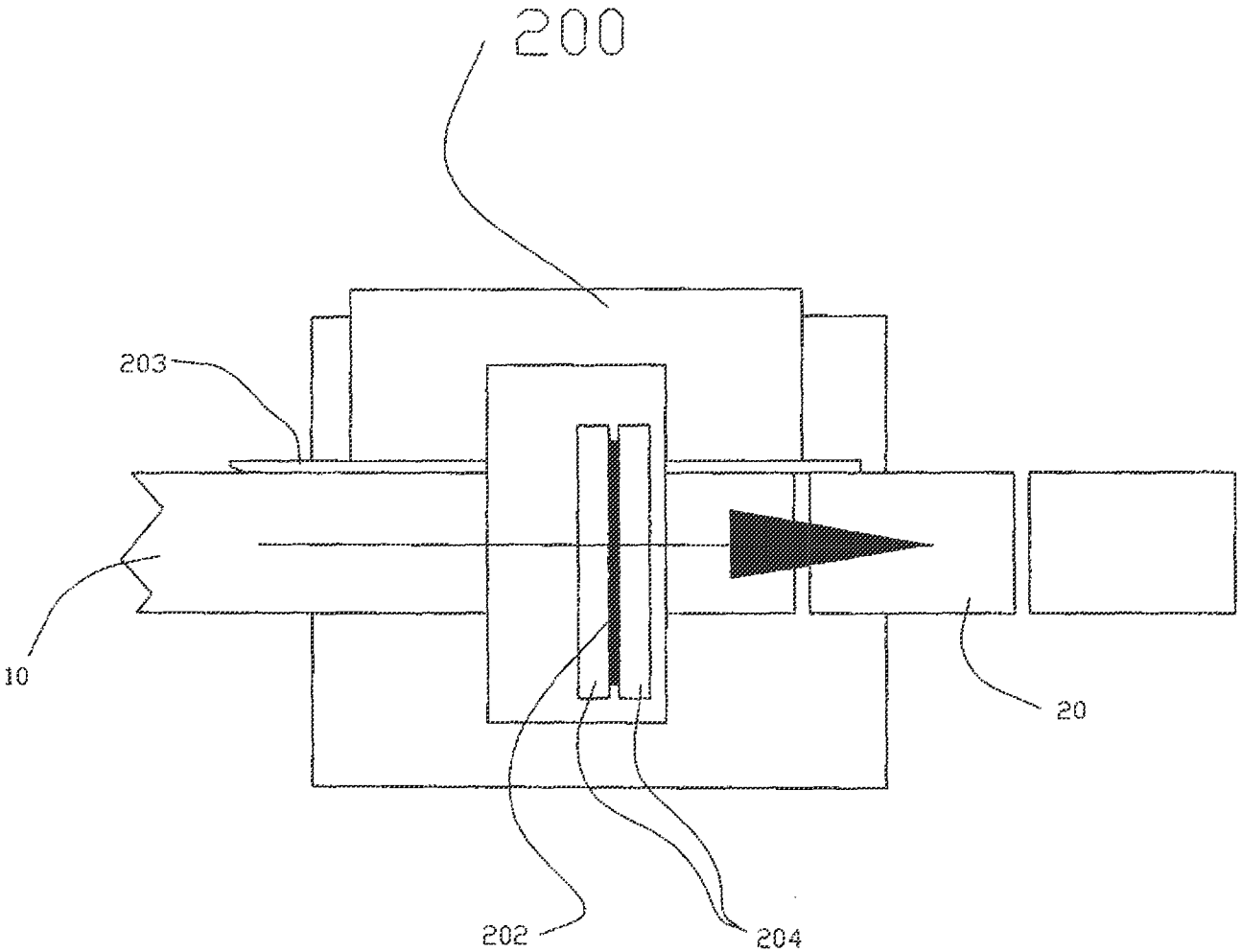
FIG. 3 is a schematic depicting an exemplary cross cut saw assembly.

After the brushing of cellular PVC board 10 is completed, cellular PVC board 10 passes in the direction of its grain through a cross cut saw assembly 200. Referring to FIG. 3, an exemplary cross cut saw assembly comprises a cross cut saw 202 which cuts the cellular PVC board into a plurality of shingle length bolts 20, wherein exemplary lengths include, for example, lengths of about 6 inches to about 25 inches, wherein about 7 inches to about 20 inches is more preferred, and wherein about 8.5 inches to about 18 inches is especially preferred. Cross cut assembly 200 further comprises a reference surface 203 which, when an edge of cellular PVC board 10 is positioned against reference surface 203, positions cellular PVC board 10 for precise right angle cross cutting. Cross cut assembly further comprises a clamp 204 located in a cutting area which pneumatically clamps both sides of cellular PVC board 10 during cross cutting.

Once securely clamped via clamp 204, cross cut saw 202, which, in an exemplary embodiment comprises an approximately 18 inch diameter carbide tipped cross cut blade, cuts board 10. Preferably the cross cut blade of cross cut saw 202 is positioned below cellular PVC board 10's travelling surface, and rotates at approximately 1,200 RPM. When the timing is appropriate, the cross cut blade is preferably pneumatically and vertically raised to cross cut cellular PVC board 10. The cross cut blade then drops back to the rest position and board 10 is unclamped. Board 10 may then be advanced to the next cut position and the next cut cycle may begin.

Figure 4:
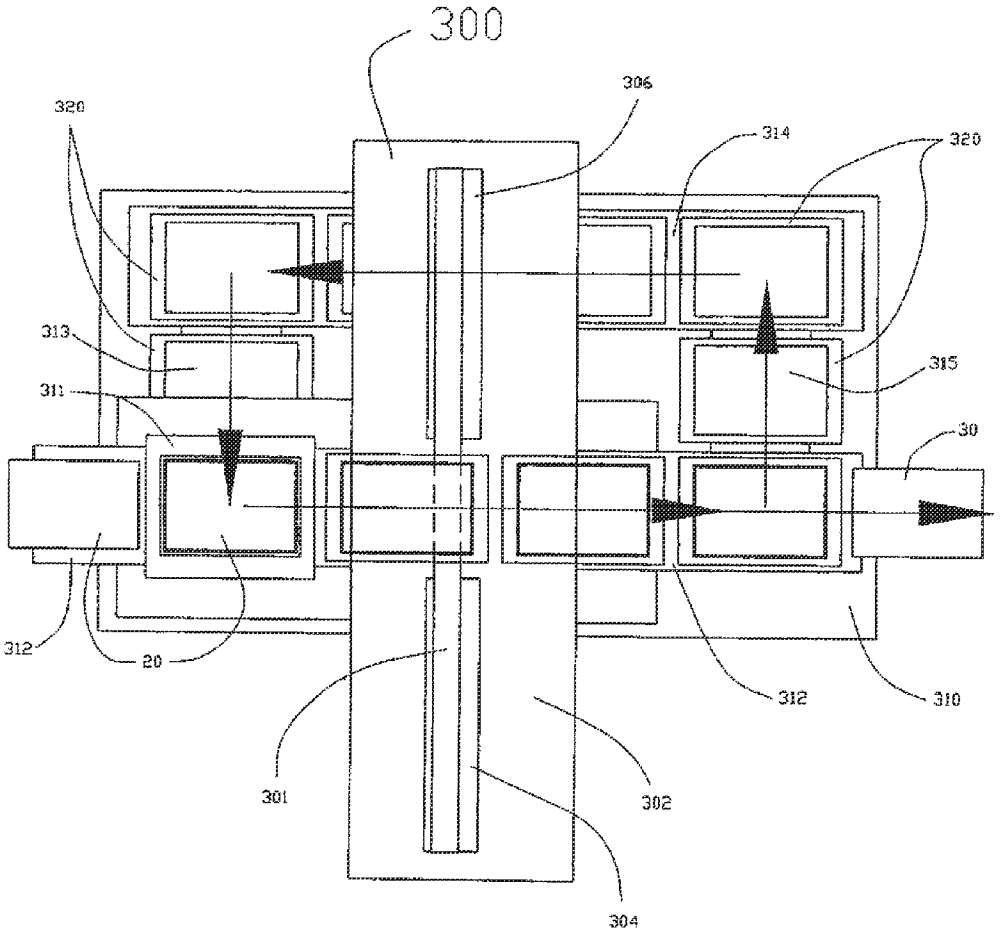
FIG. 4 is a schematic depicting an exemplary parting saw assembly.

After passing through cross cut assembly 200, bolts 20 pass, in the direction of their grain, into a parting saw assembly where, preferably, they are vertically stacked in a feeding magazine. Referring to FIG. 4, an exemplary parting saw assembly 300 comprises a high strain horizontal band saw 302 having two circular wheels 304 and 306 around which is strung a high strain, band saw blade 301, which preferably comprises carbide saw tips, and which also preferably comprises a length of about 240 inches.

Parting saw assembly 300 further comprises a pallet handling system 310. Pallet handling system 310 comprises a feeding magazine 311, a cleated main feeding conveyor 312, transfer mechanisms 313 and 315, a return conveyor 314, and a plurality of pallets 320. Bolt 20 is pneumatically separated and released from the bottom of a stack of bolts fixtured in feeding magazine 311, and dropped onto a pallet 320 positioned immediately beneath feeding magazine 311. Bolt 20 is then fixtured to main feeding conveyor 312. Pallets 320, which preferably comprise polyurethane for cost, lubricity and wear resistance, are preferably designed to passively receive and precisely position dropped bolt 20 lying flat in a slightly canted or angled position such that when main feeding conveyor 312 conveys pallet 320 carrying fixtured bolt 20 through parting saw assembly 300, bolt 20 will be parted or cut by band saw blade 301 across bolt 20's thickness starting low on bolt 20's leading edge and finishing high on bolt 20's trailing edge thus producing a pair of profiled boards, and, more specifically, opposed, precisely tapered, full width shingles 30.

Figure 5:
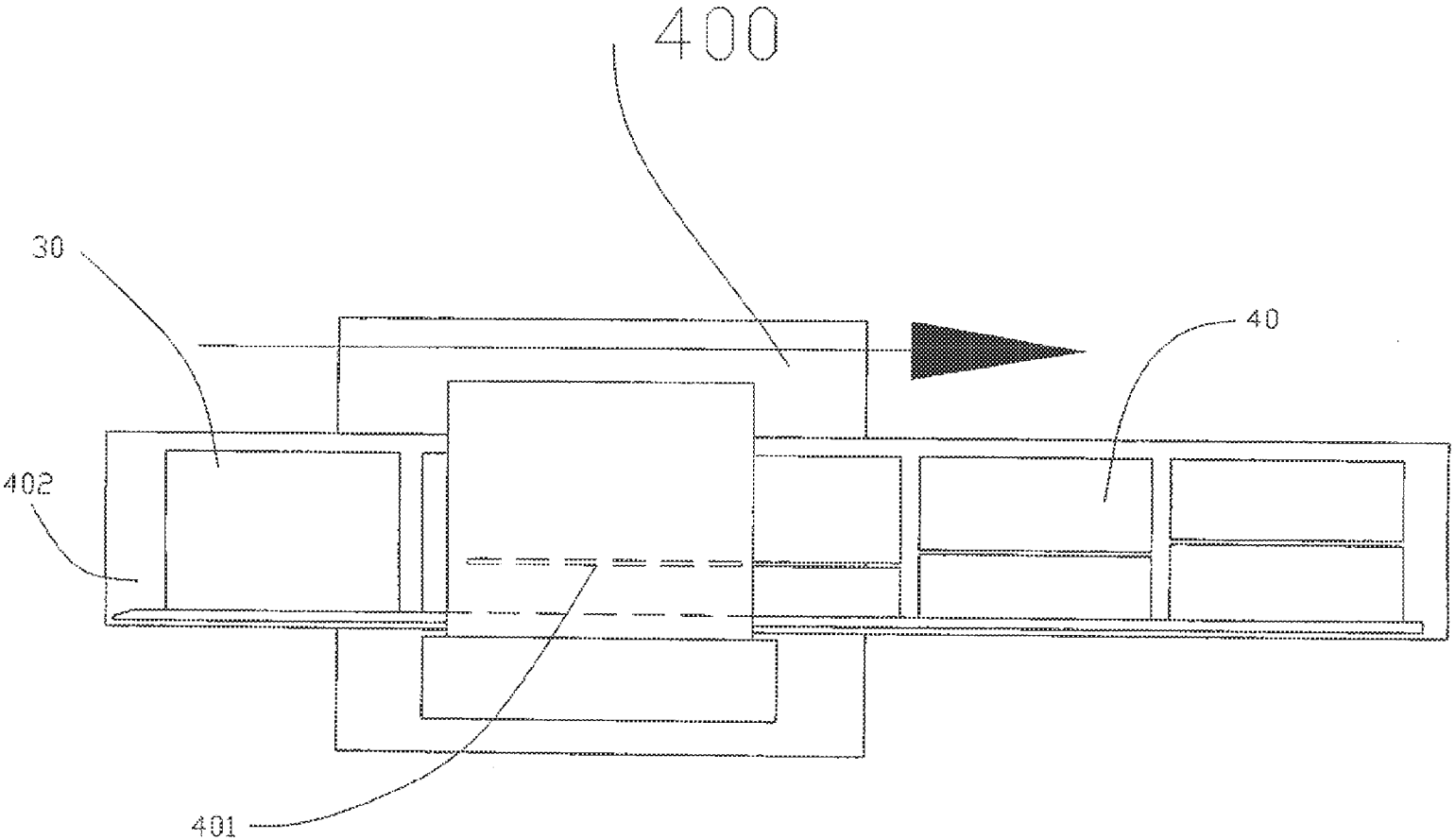
FIG. 5 is a schematic depicting an exemplary sizing saw assembly.

Referring to FIG. 5, each newly parted shingle pair 30 sequentially emerges from parting saw assembly 300 and is pneumatically lifted from pallet 320 and placed on a cleated infeed conveyor 402, where shingle pair 30 is transported, again in the direction of the shingles' respective grains, into sizing saw assembly 400. Sizing saw assembly 400 comprises an adjustable rip fence and saw blade 401, wherein, in an exemplary embodiment, saw blade 401 comprises a diameter of about 18 inches, and/or incorporates carbide tipped cutting teeth. Rip fence and saw blade 401 cuts shingle pairs 30 into desired widths to create desired sized shingles 40. In an exemplary embodiment, the throughput of sizing saw assembly 400 yields approximately one shingle per second.

Figure 6:
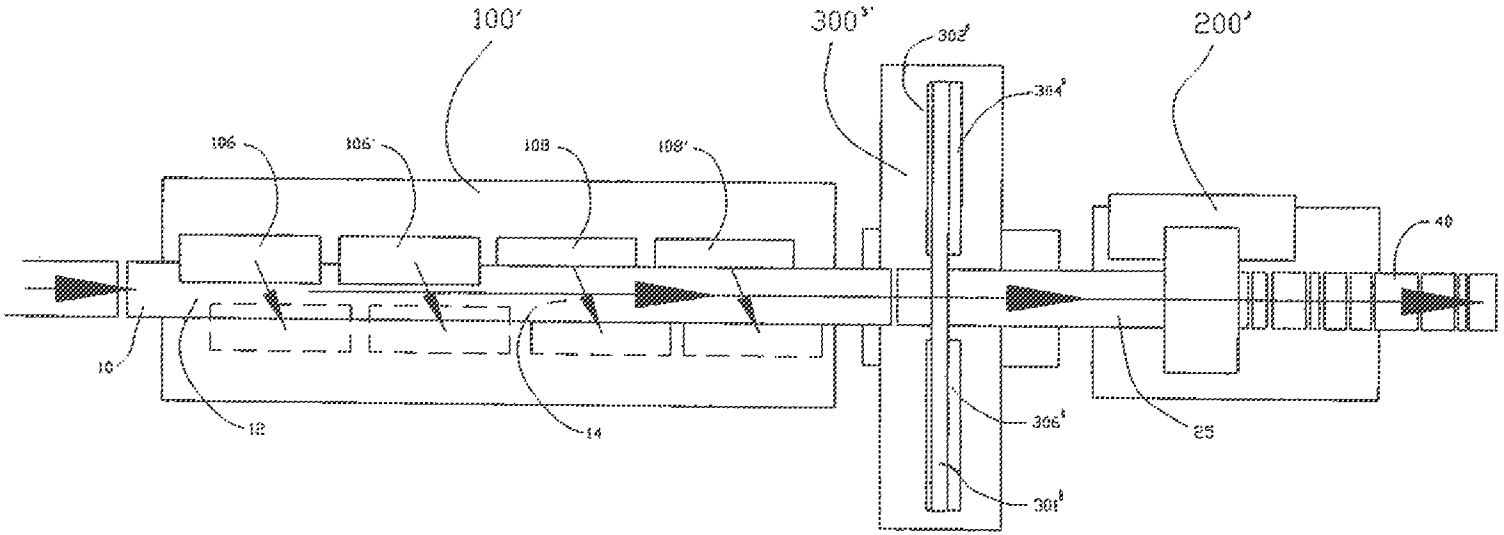
FIG. 6 is a schematic depicting an overview of another exemplary manufacturing process.

FIG. 6 depicts another embodiment of an exemplary method of forming shingles from a cellular PVC board. The method depicted in FIG. 6 differs from the method depicted in FIG. 1 in that bolts are not formed at all. Rather, the cellular PVC boards are brushed cross-wise to achieve a wood grain finish perpendicular to the long direction of the cellular PVC board as opposed to parallel with the long direction, parted in a parting assembly 300', and then conveyed, preferably at approximately 60 feet per minute, to a cross cut saw assembly 200' where the cellular PVC boards are then cut into shingles having a desired width. Although the cellular PVC board may comprise a wide variety of dimensions, in an exemplary embodiment, as the cellular PVC board is fed through brushing assembly 100', each of the boards comprises a depth of about 0.5 inch, a length of about 16 feet, and a width of about 8.5 inches, about 13 inches, about 18 inches, and the like.

More particularly, in an exemplary embodiment, a cellular PVC board 10 is fed through a brushing assembly 100'. Brushing assembly 100' comprises a brush 106 adjacent to a brush 106', and a brush 108 adjacent to a brush 108', wherein brushes 106 and 106' are oppositely situated to brushes 108 and 108'. Brushes 106 and 106' are positioned to create a grain across top face 12 of board 10, and brushes 108 and 108' are positioned to create a grain across bottom face 14 of board 10. Rather than creating the grain along a length of board 10, as was done by brushing assembly 100 in the embodiments depicted in FIGS. 1 and 2, brushes 106, 106', 108, and 108' create the grain crosswise to the length of board 10, i.e., along the width of board 10. Each of the brushes 106, 106', 108, and 108' are preferably flying brushes which move at the same rate as cellular PVC board 10 by means of a multi-axis, servo-motor powered, coordinated, positioning system that moves the brush across the board while at the same time mimicking the feed speed of cellular PVC board 10 as it travels through brushing assembly 100'.

In an exemplary embodiment, brushes 106 and 106', as well as their respective drive motors, are mounted within a two axis positioning system superstructure. This superstructure can suspend brushes 106 and 106' above board 10. During operation, brushes 106 and 106' may pneumatically descend and move horizontally across top face 12 of board 10 by servo-motor actuation. This horizontal movement is preferably angled with respect to board 10's long axis. This angle, coupled with the correct traverse speed of brushes 106 and 106' produces a perpendicular brush motion relative to board 10's long axis. After brushes 106 and 106' have brushed top face 12 of board 10, brushes 106 and 106' may be pneumatically vertically retracted and moved horizontally back to their start position where the above described cycle may be repeated. The brushing cycle may be repeated at a rate such that the brushed pattern will be slightly overlapped to produce a continuous brushed pattern across the entire length of board 10. The above described two brush, two axis, positioning system superstructure may be duplicated for brushes 108 and 108', but is positioned beneath board 10 so as to brush bottom face 14 of board 10.

After cellular PVC board 10 is fed through brushing assembly 100', cellular PVC board 10 may be fed through parting saw assembly 300'. In an exemplary embodiment, parting saw assembly 300' comprises a high strain horizontal band saw 302' having circular wheels 304' and 306' around which is strung a band saw blade 301. In an exemplary embodiment band saw blade 301 comprises carbide saw tips and has a length of about 320 inches.

In an exemplary application of parting saw assembly 300', cellular PVC board 10 is laid flat and fed at approximately 60 feet per minute through parting saw assembly 300' by a continuous motion conveyor. As it is fed in this manner, cellular PVC board 10 is continuously cut or parted into a pair of opposite facing, precisely profiled, shingle boards 25, wherein each board of pair of shingle boards 25 preferably comprises a length of about 16 feet. The profile or taper is achieved by band saw blade 301 being tilted slightly relative to the conveyor running surface.

Once profiled, pair of shingle boards 25 is transported into a cross cut saw assembly 200' in which each of the cellular PVC shingle boards pairs 25 is cut into desired-sized shingles 40, wherein exemplary widths include, for example, about 4 inches to about 12 inches. In an exemplary method, one edge of shingle board pair 25 is brought against a reference surface to position the pair for precise right angle cross cutting. Pair of shingle boards 25 is advanced into the cutting area and securely, pneumatically clamped on both sides of the intended cut path. A carbide tipped cross cut blade, which in an exemplary embodiment comprises a diameter of approximately 18", may be positioned below pair of shingle board 25's travelling surface, may be rotated at approximately 1,200 RPM, and may be pneumatically raised vertically to cross cut pair of shingle boards 25. The blade may then drop back to the rest position and board pair 25 may be unclamped. Pair of shingle boards 25 may then advance to the next cut position and the next cut cycle may begin. In an exemplary application, the throughput of the above described process may yield approximately four shingles per second.

Figure 7:
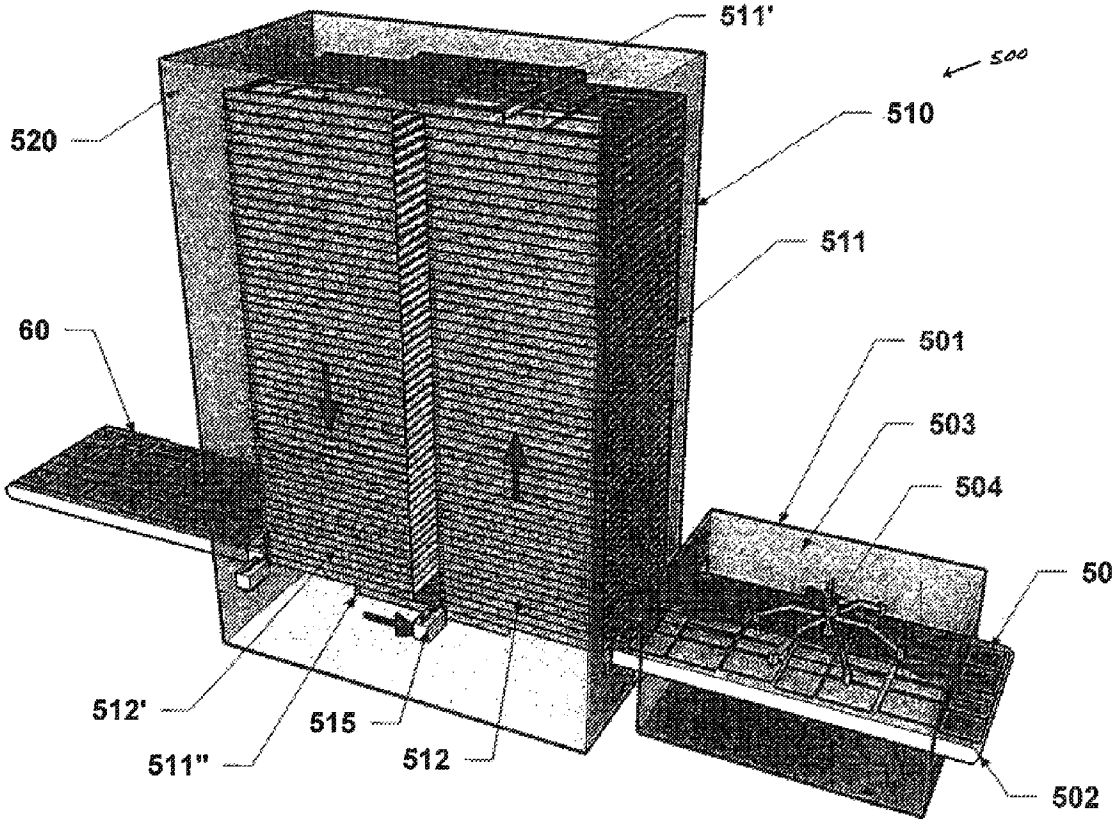
FIG. 7 is a schematic depicting an overview of an exemplary shingle coating line

Referring to FIG. 7, after emerging from any of the cross cut saw assemblies described above, the newly formed shingles may be transported to a shingle coating line 500 which comprises a flat line type, rotating head, paint booth 501. In an exemplary embodiment, shingles 50 may be placed, manually and/or automatically, flatwise with brushed surface facing up onto an approximately 5 foot wide continuous motion, self cleaning conveyor 502. Conveyor 502 may transport shingles 50 at approximately 25 feet per minute into a spray booth 503 housing a continuously rotating, approximately 4 foot diameter, spray head 504, wherein, in an exemplary embodiment, spray head 504 comprises six spray nozzles. Each of shingles 50 is preferably coated with a two part polyurethane Polane paint to a wet thickness of approximately 5 mils.

After coating, shingles 50 emerge from spray booth 503 and are conveyed into a vertical drying oven 510. In an exemplary embodiment, drying oven 510 comprises approximately 120 conveying trays 511 lying flat and stacked in tray elevators 512 and 512', wherein tray elevator 512 ascends, and tray elevator 512' descends. Each of conveying trays 511 is preferably a lightweight, externally powered, transport conveyor approximately 5 feet in length and width.

In continuous fashion, a conveying tray 511 is positioned at the output end of paint booth conveyor 502 where a drive motor 515 advances and docks with conveying tray 511's drive shaft. A conveying tray's worth of wet shingles is then fully conveyed onto conveying tray 511, drive motor 515 retracts, tray elevator 512 ascends on the input side and tray elevator 512' descends on the output side index one level. Simultaneously during loading of each conveying tray 511 at the input of drying oven 510, the following operations occur: dried shingles 60 are unloaded at drying oven 510's output, a loaded conveying tray 511' is transferred from the top of tray elevator 512 to the top of tray elevator 512', and an unloaded conveying tray 511" is transferred from the bottom of tray elevator 512' to the bottom of tray elevator 512.

In an exemplary embodiment, this entire mechanism and its operations are enclosed in an insulated enclosure 520 which comprises baffles and duct work to control heat, inlet air and exhaust as to subject each of the shingles to about 10 minutes of flash-off time at ambient temperature, about 20 minutes of cure time at approximately 130 degrees Fahrenheit, and about 10 minutes of cool down at ambient temperature. The above described coating/drying process yields approximately one shingle per second or approximately 2 squares (1 square=100 square feet) per hour.

It is additionally noted that prior to painting, a plurality of shingles formed by any of the above-discussed exemplary methods may be adhered to a backer board by means of a glue or other adhesive to form a shingle panel. In this embodiment, each shingle is preferably applied to the backer board such that the shingles in one row are not identically aligned with any of the shingles disposed in an adjacent row. Rather, the shingles are preferably disposed onto the backer board such that the shingles in one row are staggered in relation to the shingles in an immediately adjacent row(s). Once applied to the backer board, the newly formed panel may be painted and cured as above-described.

Although the principles of the present invention have been illustrated and explained in the context of certain specific embodiments, it will be appreciated by those of skill in the art that various modifications beyond those illustrated can be made to the disclosed embodiment without departing from the principles of the present invention.

What is claimed is:

1. A method of manufacturing shingles formed of cellular polyvinyl chloride, wherein the method comprises:

providing a brushing assembly, wherein the brushing assembly comprises a first brush adjacent to a second brush, and a third brush adjacent to a fourth brush, wherein the first and second brushes are oppositely situated to the third and fourth brushes:

providing a cross cut saw assembly, wherein the cross cut saw assembly comprises a cross cut saw;

providing a parting saw assembly, wherein the parting saw assembly comprises a band saw comprising a first wheel opposite to a second wheel, and a band saw blade disposed around the first wheel and the second wheel;

providing a sizing saw assembly, wherein the sizing saw assembly comprises an infeed conveyor in line with a saw blade;

providing a cellular polyvinyl chloride board comprising a top face opposite to a bottom face, a front face opposite to a back face, and a first lateral face opposite to a second lateral face;

feeding the cellular polyvinyl chloride board through the brushing assembly;

applying the first and second brushes to the top face of the board to create a textured grain pattern on the top face;

applying the third and fourth brushes to the bottom face of the board to create a textured grain pattern on the bottom face;

feeding the cellular polyvinyl chloride board from the bushing assembly to the cross cut saw assembly in a direction parallel to the board's textured grain pattern;

cutting the cellular polyvinyl chloride board crosswise to form a plurality of shingle length bolts comprising passing the cellular polyvinyl chloride board through the cross cut saw;

feeding the plurality of shingle length bolts into the parting saw assembly in a direction parallel to the bolt's textured grain pattern;

creating a pair of profiled boards by passing a bolt from the plurality of shingle length bolts widthwise through the band saw;

feeding the pair of profiled boards through the sizing saw assembly via the infeed conveyor; and cutting the pair of profiled boards via the saw blade to create a desired sized shingle.

2. The method of claim 1, wherein the first and third brushes rotate in a direction opposite to a direction of rotation of the second and fourth brushes.

3. The method of claim 1, wherein the textured grain patterns are visually identical to real rough-sawn wood.

4. The method of claim 1, wherein the cross cut saw assembly further comprises a reference surface; and wherein feeding the cellular polyvinyl chloride board into the cross cut saw assembly comprises resting the first lateral side of the board against the reference surface so that a precise right angle cross cut of the cellular polyvinyl chloride board is achieved when the board is cut by the cross cut saw.

5. The method of claim 4, wherein the cross cut saw assembly further comprises a pneumatic clamp; and wherein the method further comprises pneumatically clamping the cellular polyvinyl chloride board with the pneumatic clamp while the cellular polyvinyl chloride board is cut by the cross cut saw.

6. The method of claim 1, wherein cutting the polyvinylchloride board via the cross cut saw comprises positioning the cross cut blade beneath the polyvinylchloride board and then vertically raising the cross cut blade through the board.

7. The method of claim 1, wherein the parting saw assembly further comprises a pallet handling system comprising a feeding magazine, a main feeding conveyor, a return conveyor, and a plurality of pallets, and wherein feeding the shingle length bolts into the parting saw assembly comprises:

collecting the plurality of shingle length bolts into the feeding magazine;

pneumatically separating and releasing each bolt from the feeding magazine;

placing each bolt on one of the plurality of pallets, wherein the one pallet is positioned on the main feeding conveyor;

conveying the bolt disposed on the one of the plurality of pallets positioned on the main feeding conveyor through the band saw blade to create the pair of profiled boards;

pneumatically lifting the pair of profiled boards from the pallet and feeding the pair of profiled boards to the sizing saw assembly;

redirecting the one of the pallets of the plurality of pallets to the return conveyor; and conveying the one of the pallets of the plurality from the return conveyor to the feeding magazine.

8. The method of claim 1, further comprising:

providing a shingle coating line, wherein the shingle coating line comprises:

a spray booth housing a spray head including spray nozzles;

a drying oven comprising an ascending tray elevator and a descending tray elevator, each of the tray elevators holding a plurality of trays;

conveying the shingle to the spray booth housing;

coating the shingle with a paint applied to the shingle via the spray nozzles to form a coated shingle;

drying the coated shingle, wherein drying comprises conveying the coated shingle to a tray located on the ascending tray elevator, moving the tray holding the coated shingle upwards to a top of the drying oven, conveying the tray holding the coated shingle to the descending tray elevator, and moving the tray holding the coated shingle downwards away from the top of the drying over via the descending tray elevator; and outputting the coated shingle from the oven.

9. A method of manufacturing shingles formed of cellular polyvinyl chloride, comprising:

providing a brushing assembly, wherein the brushing assembly comprises a first brush adjacent to a second brush, and a third brush adjacent to a fourth brush, wherein the first and second brushes are oppositely situated to the third and fourth brushes:

providing a parting saw assembly, wherein the parting saw assembly comprises a band saw comprising a first wheel opposite to a second wheel, and a band saw blade disposed around the first wheel and the second wheel;

providing a cross cut saw assembly, wherein the cross cut saw assembly comprises a cross cut saw;

providing a cellular polyvinyl chloride board comprising a top face opposite to a bottom face, a front face opposite to a back face, and a first lateral face opposite to a second lateral face;

feeding the cellular polyvinyl chloride board lengthwise through the brushing assembly;

applying the first and second brushes to the top face of the board to create a textured grain pattern cross-wise to a length of the cellular polyvinyl chloride board;

applying the third and fourth brushes to the bottom face of the board to create a textured grain pattern oriented cross-wise to the length of the cellular polyvinyl chloride board;

feeding the cellular polyvinyl chloride board from the brushing assembly to the parting saw assembly;

passing the cellular polyvinyl chloride board through the band saw blade while tilting the band saw blade relative to the cellular polyvinyl chloride board to create a pair of profiled shingle boards;

feeding the pair of profiled shingle boards into the cross cut saw assembly; and passing the pair of profiled shingle boards through the cross cut blade to form a desired sized shingle.

10. The method of claim 9, wherein the first, second, third, and fourth brushes comprise flying brushes which are powered by a multi-axis, servo-motor powered, coordinated positioning system, and further wherein the first, second, third, and fourth brushes move at the same rate of speed as the feed of the cellular polyvinyl chloride boards through the brushing assembly.

11. The method of claim 9, wherein the textured grain patterns are visually identical to real rough-sawn wood.

12. The method of claim 9, wherein the cross cut saw assembly further comprises a reference surface; and wherein feeding the pair of profiled shingle boards into the cross cut saw assembly comprises resting the first lateral side of the pair of profiled shingle boards against the reference surface so that a precise right angle cross cut of the cellular polyvinyl chloride board is achieved when the cellular polyvinyl chloride board is cut by the cross cut saw.

13. The method of claim 12, wherein the cross cut saw assembly further comprises a pneumatic clamp; and the method further comprising pneumatically clamping the pair of profiled shingle boards with the pneumatic clamp while the pair of profiled shingle boards is cut by the cross cut saw.

14. The method of claim 13, wherein cutting the pair of profiled shingle boards comprises positioning the cross cut blade beneath the pair of profiled shingle boards and then vertically raising the cross cut blade through the pair of profiled shingle boards.

15. The method of claim 9, further comprising:

providing a shingle coating line, wherein the shingle coating line comprises:

a spray booth housing a spray head including spray nozzles;

a drying oven comprising an ascending tray elevator and a descending tray elevator, each of the tray elevators holding a plurality of trays;

conveying the shingle to the spray booth housing;

coating the shingle with a paint applied to the shingle via the spray nozzles to form a coated shingle;

drying the coated shingle, wherein drying comprises conveying the coated shingle to a tray located on the ascending tray elevator, moving the tray holding the coated shingle upwards to a top of the drying oven, conveying the tray holding the coated shingle to the descending tray elevator, and moving the tray holding the coated shingle downwards away from the top of the drying over via the descending tray elevator; and outputting the coated shingle from the oven.

* * * * *